United States Patent [19]

Legoy et al.

[11] Patent Number: 5,013,269

[45] Date of Patent: May 7, 1991

[54] MODULAR NAVIGATION VESSEL EQUIPPED WITH ROTATING FLOATS

[75] Inventors: Auguste Legoy, 25 Rue Guillaume Apollinaire; Alain Quibel, 123 Avenue Foc, both of 76290 Montivilliers, France

[73] Assignees: Auguste Legoy; Alain Quibel; Marthe Saillard; Claude Legoy; Philippe Legoy, all of Montivilliers; Annick Legoy, Balan Mire; Yvette Hamel, Montivilliers; Anne-Sophie Quibel, Montivilliers; Pierre Quibel, Montivilliers; Vincent Quibel, Montivilliers, all of France

[21] Appl. No.: 233,208

[22] Filed: Aug. 17, 1988

[30] Foreign Application Priority Data

Aug. 17, 1987 [FR] France ..... 8711653

[51] Int. Cl.[5] ..... B63H 1/38

[52] U.S. Cl. ..... 440/100; 114/61; 114/270; 114/352

[58] Field of Search ..... 114/77 R, 270, 352, 114/61; 440/90, 98, 100; 296/203

[56] References Cited

U.S. PATENT DOCUMENTS

| | | | |
|---|---|---|---|
| 1,637,336 | 8/1927 | Cook | 114/270 |
| 2,384,981 | 9/1945 | Wallace | 114/77 R |
| 3,078,938 | 2/1963 | Bollum | 114/77 R |
| 3,310,020 | 3/1967 | Slemmons | 440/100 |
| 3,628,493 | 12/1971 | Headrick | 114/270 |
| 3,744,071 | 7/1973 | Bossler | 114/352 |
| 3,908,577 | 9/1975 | Struyk | 114/270 |
| 4,627,372 | 12/1986 | Douglas | 114/77 R |
| 4,676,545 | 6/1987 | Bonfilio et al. | 296/203 |

*Primary Examiner*—Sherman D. Basinger
*Assistant Examiner*—Thomas J. Brahan
*Attorney, Agent, or Firm*—Scully, Scott, Murphy & Presser

[57] ABSTRACT

A modular navigation vessel having rotating floats includes a forward module ending in a stem, a central module in the form of a caisson and a rear module, all three modules being ridigly assembled by means of removable connection means. The modules are provided with lateral walls which are connected together in an uninterrupted manner to form a regular hull from the stem to the stern, where at least the second and third modules are equipped with axles carrying rotating floats having a size which keeps the hull entirely above the surface of the water. The floats are equipped in the vicinity of their periphery with a plurality of rigid paddles which are spaced at a constant angle from one another and have a concave shape.

19 Claims, 8 Drawing Sheets

MODULAR NAVIGATION VESSEL EQUIPPED WITH ROTATING FLOATS

BACKGROUND OF THE INVENTION

Navigation vessels, such as craft of all types, caissons, hulls, rafts, toys and small models generally move over the water by sliding. This sliding introduces frictional forces which are all the greater when the immersed surface of the vessel is large and the speed of the latter increases.

In order to reduce the amount of friction, it is customary to give the hull a hydrodynamic profile which enables the layers of water in immediate contact with the hull to slide over the latter in a laminar way and therefore to avoid giving rise to eddies or whirlpools. However, although it is possible to eliminate the frictional forces for very low speeds of displacement of the vessel in this way, it is no longer the case when the speed increases, given that the resistance to forward progress varies as a function of the square of the speed. The result of this is that a considerable fraction of the energy developed by the drive means used is employed to overcome friction and does not serve to drive the vessel.

Patents FR 387,781 and 984,997 disclose marine pleasure or leisure vehicles which partially remedy these drawbacks in that they are equipped with rotating floats which keep the hull entirely out of the water. These floats are equipped with a plurality of blades which are uniformly spaced along their periphery and which are more or less inclined with respect to the respective associated radial planes.

However, such vehicles still have a limited performance, in particular because of the high energy loss due to whirlpools created by the impact of the blades on the water surface. Therefore, in Patent FR 387,781, the floats have a hollow crown shape with a V-shaped cross-section. This shape introduces a loss of performance due to the friction of the water on the inner cylindrical wall of the float. With respect to the vehicle according to Patent FR 984,997, there are helical blades on its floats which achieve a vigorous stirring of the water and therefore a consumption of energy which is lost for driving the navigation vehicle.

Moreover, all known navigation vessels have a precise shape which cannot be modified in any way. A given vessel is therefore suitable only for a well defined use and gives a performance which cannot be changed. Builders are therefore obliged to produce not only all the conventional types of craft, such as motorboats, outboard motorboats, sailing boats, trimarans, catamarans, and the like, but also, for each of these types, models of different lengths and widths. Considerable sums have to be invested and this is naturally reflected in the purchase price. Moreover, this diversity of craft makes large-scale production difficult.

Patent EP 0,064,271 discloses a navigation vessel which as emerges from reading said patent, provides a modular-structure which has no aim other than to enable the modules to be nested in one another in order for it to be possible to transport the vessel in a small space, for example in a trailer towed by a motor vehicle or on the roof of the latter. However, nowhere is it suggested in this patent that the vessel may be converted into other types of vessel. The shape of the modules used does not, moreover, lend itself to such a conversion.

SUMMARY OF THE INVENTION

The aim of the present invention is to remedy these drawbacks of the prior art by proposing a navigation vessel which may readily be converted to assume the appearance of the different types of known navigation vessel and which, moreover, gives a performance which is markedly better than known craft of the same type.

Various elements may be fixed in a removable manner to the main and intermediate modules, enabling a specific character to be given to the type of vessel built. For example, it is possible to fix, straddling the forward module and the central module, either a pilot cabin housing a steering rod for controlling the steering floats, or alternatively a deck. A rest cabin and a gripping collar for a mast may be installed on the central module. A keel may be installed under the central module. The rear module may have a motor with means for transmission of the movement to the two shafts bearing the drive floats and between which a differential is inserted. The various modules may be equipped with mooring points and metal rings making it possible to fix the rigging for maneuvering the sails thereto.

Therefore, it is possible to appreciate the large number of possible combinations that may be achieved using these modules. For example, by assembling a forward module, a central module and a rear module to each other and by fixing a motor on the rear module and a pilot cabin and a rest cabin on the other two modules, a motorboat is obtained. This boat may be converted to a sailing boat by removing the motor and the pilot cabin and by fixing, on the one hand, a mast bearing at least one sail in the gripping collar and, on the other hand, a keel under the central module.

The boat or sailing boat may be given different lengths by inserting one or more intermediate modules between the main modules.

Moreover, the boat or sailing boat may be converted into a trimaran by joining thereto two lateral arms which are fixed on the hull of one of the modules and which bear at their end one or more floats.

Another interesting combination consists in using two identical assemblies of three main modules and possibly one intermediate module, the two assemblies being arranged in parallel and integrally connected by an assembly plate. A catamaran is thereby obtained. In the same vein, it is possible to use two identical assemblies each comprising one central module and a rear module in a line, the two assemblies being coupled along their side and integrally connected together in order to form a vessel of a width double that of a basic vessel, a single forward module ending in a stem being fixed forward of the two central modules. A type of barge is thereby obtained which has very good stability since its support polygon on the water is much greater than that of a basic boat.

All these types of vessels may be produced to full size or as a small model, or alternatively in the form of a toy. Therefore, from a small number of modules and accessories, it is possible at will to achieve a large variety of nautical vehicles. Obviously the cost of the assembly is much less than would be occasioned by purchasing conventional vessels according to all the abovementioned models. According to the financial resources of the user, it would be possible to acquire firstly the main elements which enable him to build a motorboat, then to purchase subsequently the accessories, the intermediate modules and a forward module of double width in order to have the option of modifying, according to his wishes, the type and the dimensions of the vessel.

The floats are housed in cavities formed in the base of the modules. The part of the floats which projects inside the modules is protected by a fairing.

The floats are produced in materials which are light but which have good resistance to impacts and to corrosion, for example in certain metals such as zinc or aluminum or in certain alveolar plastics. They would preferably have a hollow structure reinforced by internal partitions.

According to an advantageous embodiment, each float has a cylindrical or preferably frustoconical shape whose large base is equipped with a boss or peripheral crown to which the paddles are fixed on the internal side adjacent to the frustoconical wall. The floats driven by the water are equipped in their axis with a ball bearing, whilst the floats driven by the motor are arranged to receive an axle.

The paddles may be in the form of bent blades comprising a first wall which is connected perpendicularly to the internal annular side of the crown and which is more or less inclined with respect to the associated radial plane, and a second wall, bent at an obtuse angle with respect to the first wall.

For high-speed navigation vehicles, the paddles of the floats are preferably in the form of half cylinders with an axis parallel to that of the float, the concave side of the paddles being oriented in a manner such that the paddle which penetrates into the water attacks the surface of the water with a solid surface and that which emerges from the water has its concave side turned downwards.

According to their position on the navigation vessel, the floats may be mounted singly or in pairs by means of their face or by means of their small face. For example, in order to provide steering for the vessel, two floats coupled by means of their large base are used on the central module, this arrangement having the advantage that the two peripheral crowns together form a stem. These two floats are integrally joined by means of several bolts which pass through them axially, and of nuts. The assembly of the two floats is mounted so as to swivel in bearings carried by the ends of the branches of a fork provided with a vertical pivot which itself swivels in a bearing which is integral with the structure of the vessel. The rotation of the assembly of the fork and of the steering floats is controlled by means of a bar installed in the pilot cabin, by means of transmission means.

In order to give the vessel the three support points necessary for its stability, the rear module is equipped with at least two separate floats whose small faces are turned towards each other in a manner such that the peripheral crowns are separated as much as possible from one another. The rear floats swivel on an axle carried by a rear deck and/or by the lateral walls of the rear module. If the vessel comprises intermediate modules, at least some of these may be equipped with a motor for driving the floats of the corresponding modules.

The crown of each float is provided on its edge with a rim into which a solid or inflated tire may be inserted. The navigation vessel thereby becomes able to roll and may be attached to the rear of a motor vehicle in order to be towed to the place of use. It is also possible for it to run on the beach up to the water's edge, or quite simply to use it as a wheeled sailing boat.

BRIEF DESCRIPTION OF THE DRAWINGS

The invention will be better understood on reading the following description of several embodiments given solely by way of examples with respect to the appended drawings, in which:

FIG. 15*a* shows the action of the water on a semicylindrical paddle;

DETAILED DESCRIPTION OF THE PREFERRED EMBODIMENTS

Figure 1:
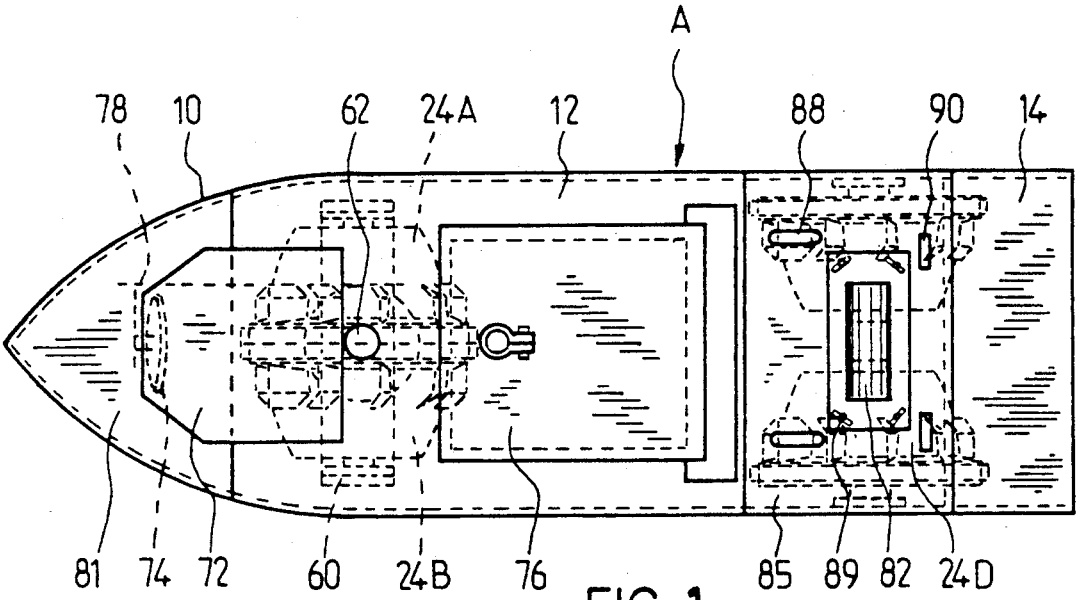
FIG. 1 is a plan view of a motorboat formed from three main modules according to the invention.
Figure 2:
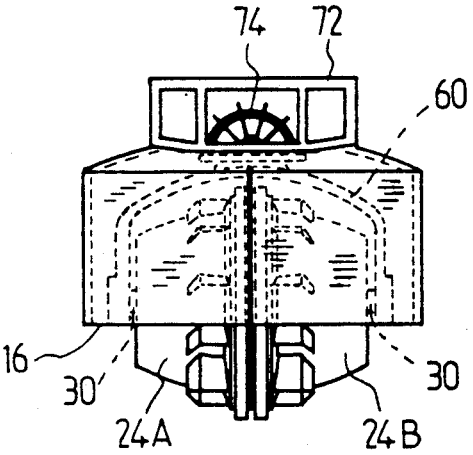
FIGS. 2 and 3 are, respectively, views from the forward and rear end of the boat of FIG. 1.
Figure 3:
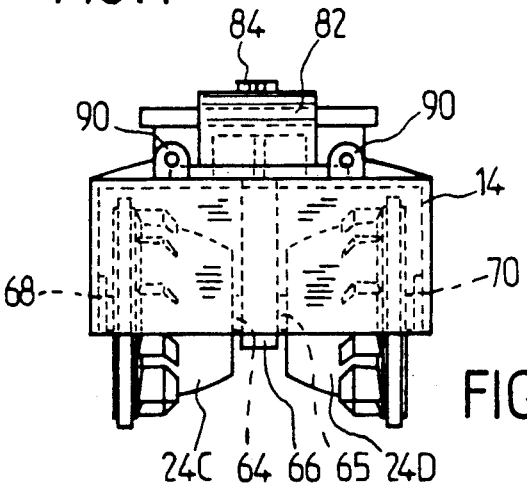

The motorboat A represented in FIGS. 1 to 4 is designed for pleasure, sport or may also be produced in the form of a small model or of a toy. It essentially comprises three modules 10, 12, 14 which are rigidly assembled together by means of conventional connections, which are not shown, and in the case of toys, by means of hooks.

The forward module 10 is tapered in a stem shape, whilst the central module 12 and the rear module 14 consist of substantially parallelepipedal caissons with parallel lateral walls and flat bottoms 16, 18. Their lateral walls are joined together to form a regular hull. In FIGS. 1 to 4, these lateral walls are plane, but they may obviously be given a curved shape which has a better coefficient of penetration in the water. The modules are arranged in a line. In order that the internal volume that they define is continuous from one end to the other of the boat, the transverse walls located according to the joining planes of the modules are removed. However, if desired, these walls may be retained in order to form transverse partitions inside the boat.

The lateral walls of the central module are perforated with two orifices 112, 114 (or more) for the optional fixing of accessories, as will be explained below. By virtue of the large stresses which act on the vessel, during navigation on the open sea, the lateral walls of the central module may be connected together by means of fixed removable spacers, for example at the location of the orifices 112, 114.

The bases 16 and 18 of the central and rear modules have two semicylindrical cavities projecting towards the inside which are limited by fairings 20, 22. Inside these cavities floats 24 are mounted so as to rotate, which floats have a design and a size such that they keep the boat above the surface of the water.

Figure 11:
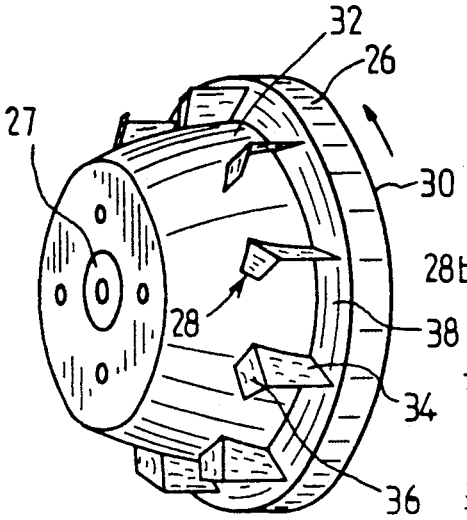
FIG. 11 is a perspective view of a float according to the invention.
Figure 12:
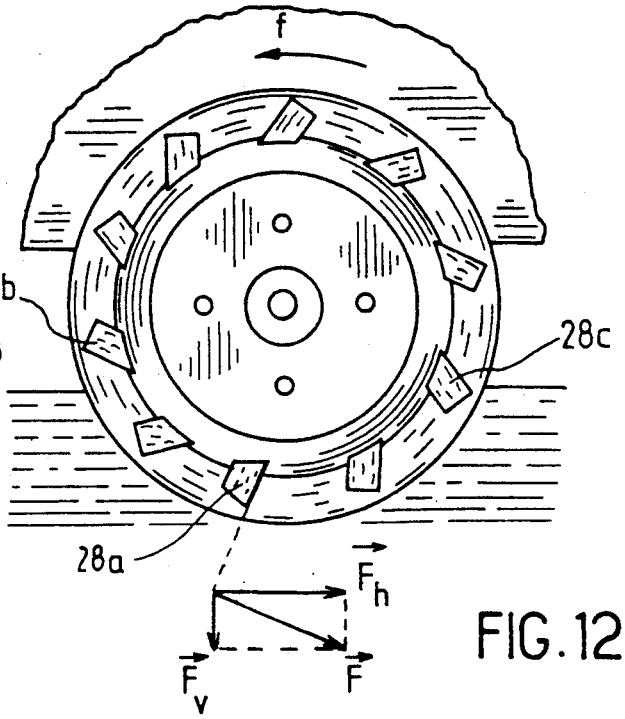
FIG. 12 is a side view from the small face of the float.

The floats are produced in a low-density material which can withstand impacts, for example in an aluminum alloy or in an alveolar plastic. They are preferably hollow and reinforced on the inside by means of radial partitions. As shown in FIGS. 11 and 12, they are substantially frustoconical but may also be cylindrical. In the vicinity of their large base 30, they are provided with an annular rim or crown 26 of a larger diameter than the large base. The floats driven by the water comprise a ball bearing 27 mounted according to their axis. The floats driven by an motor have an axial perforation intended to receive an axle. A plurality of paddles 28 spaced at a constant angle are fixed to the frustoconical wall 32 of the float. Each paddle comprises a central flap 34 and a lateral flap 36 which together form an obtuse angle, preferably equal to 130°. The central flap has a radial or slightly inclined direction as indicated by FIG. 12 and it is connected to the adjacent side 38 of the crown 26, which is slightly frustoconical.

When the float rotates in the direction of the arrow f in FIG. 12, the lowest immersed paddle 28*a* forces a quantity of water rearwards with a force F which is substantially perpendicular to the plane of the flap 34. By virtue of its small inclination with respect to the horizontal, this force has a large horizontal component $F_h$ which propels the boat forwards, and a relatively small vertical component $F_v$ directed downwards. By virtue of the principle of action and reaction, this vertical component tends to raise the boat and therefore to cause the floats to emerge slightly from the water. This tendency is reinforced by the action of the paddle 28*b* which begins to penetrate into the water since the angle of attack of its flap 34 is practically zero. On the other hand, the emerging paddle 28*c* is slightly inclined with respect to the water surface and emerges with little resistance. The lateral flap 36 of the paddles further increases the aquaplane phenomenon by reducing the whirlpools caused by the emerging paddles. The frictional forces which normally oppose the advance of nautical vehicles are therefore greatly reduced by virtue of the float according to the invention. Tests have also shown a considerable attenuation of the accompanying waves, both transverse and divergent. Experience shows that at an average speed of 10 to 30 knots, the energy saving is in the region of 30%.

An excellent performance is also obtained when the floats comprise a granulation on their lateral wall. This ensures good adherence with the water and therefore satisfactory drive. In some cases, it is then possible to remove the paddles.

Figure 13:
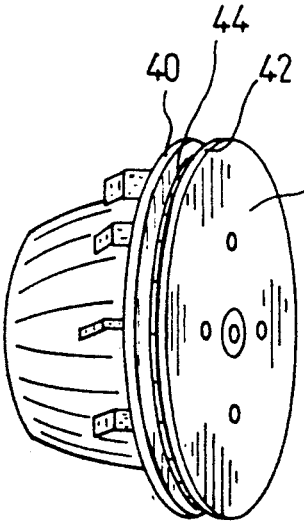
FIG. 13 is a perspective view of a float equipped with a rim.
Figure 14:
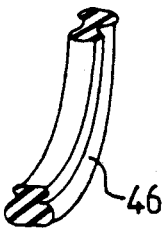
FIG. 14 is a partial view of a tire intended to be inserted in the rim.

In the embodiment variant of FIG. 13, the float is equipped on the periphery of its crown with annular flanges 40, 42 which together define a rim 44 into which a solid or inflated tire 46 (FIG. 14) may be inserted. In this manner, the nautical vehicle may be towed on the road by a motor vehicle.

The paddles may be removable. They may also be associated with a device which makes it possible to automatically retract them inside the crown, for example when the vehicle is towed on the road or when the speed exceeds a threshold.

Figure 15:
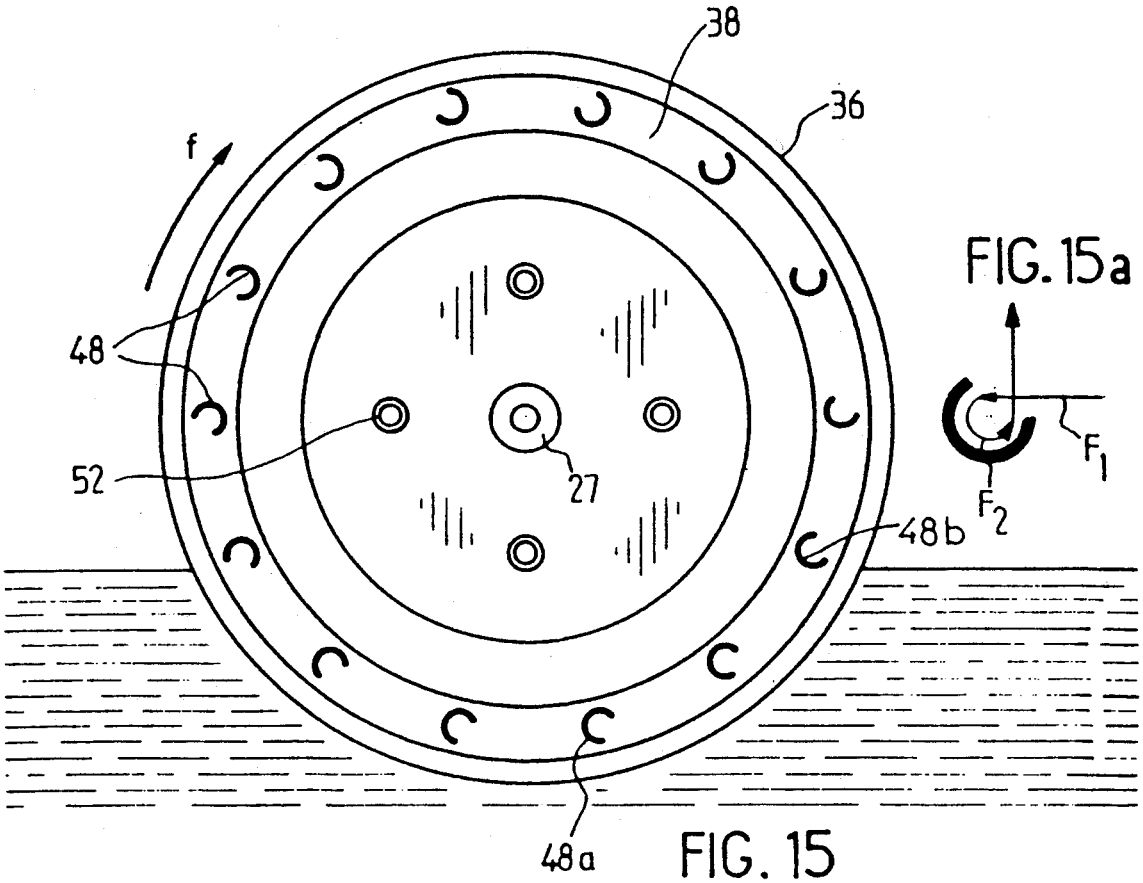
FIG. 15 shows a float equipped with semi-cylindrical paddles.

FIG. 15 represents a float equipped with another type of paddle 48. In this case, the paddles are semi-cylindrical, a shape which is particularly suitable for nautical vessels moving at high speed. They are embedded on the internal side 38 of the crown 36 so that their axis is parallel to the axis 27 of the float. It will be noted that the concave side of the paddles is oriented so that the immersed paddles move the water with their convex surface.

The paddle emerging from the water has its concave side turned downwards such that it produces practically no whirlpools when it emerges.

As shown in FIG. 15*a*, the current of water penetrates into the paddle which has just been immersed in the direction of the arrow $F_1$. This current gives rise in the paddle to a swirling current in the direction $F_2$ which rotates counterclockwise. These two currents promote the rotational drive of the float. This type of paddle will preferably be chosen for driven floats, since it gives a good performance and offers less resistance than a flat paddle. The forces of action and of reaction are at a maximum and impart a rotational movement to the floats.

Figure 16:
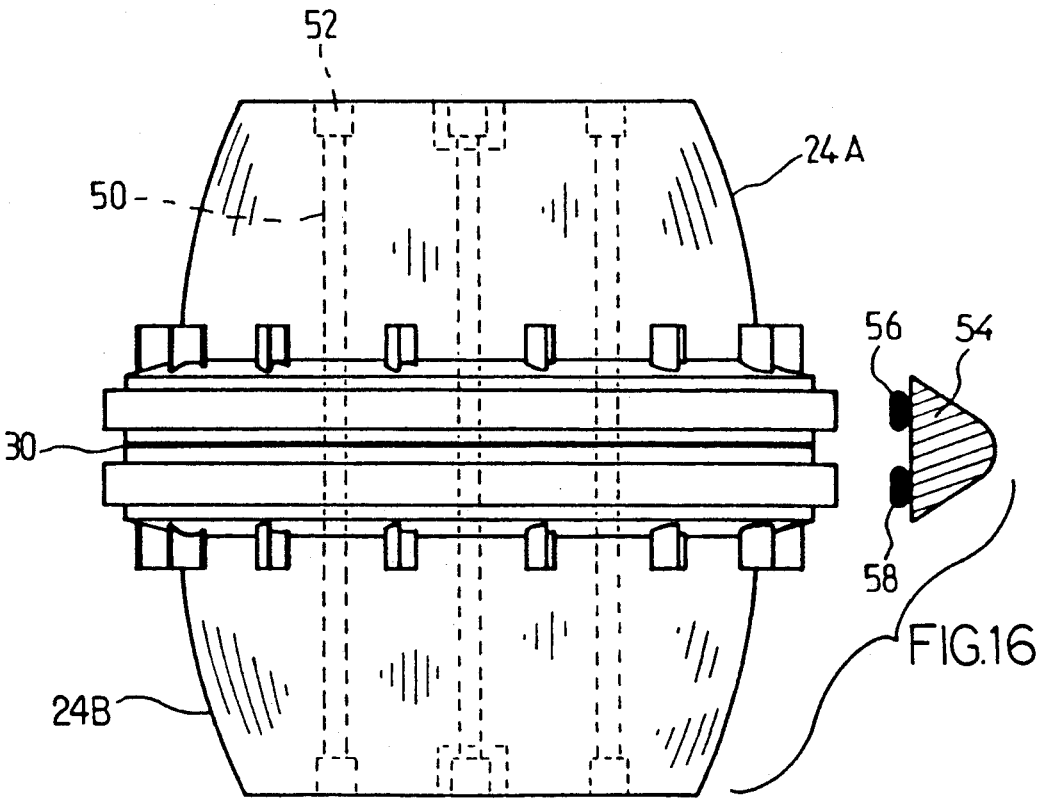
FIG. 16 represents two floats according to FIG. 15, paired along their large face.

As shown in FIG. 16, two floats 24A and 25B (sic) may be coupled coaxially according to their large base 30 and made integral in rotation, for example by means of four bolts which enter into holes 50, which pass through axially, and which are secured by means of nuts which are housed in cavities 52. If the floats are equipped with rims, as in the embodiment of FIG. 13, it is possible to provide, instead of two tires, a single solid tire 54 with a substantially triangular cross-section and equipped with portions 56, 58 for anchoring in the rims. The triangular tire gives the floats thereby paired the shape of a stem, which is very efficient especially for the steering floats.

Figure 17:
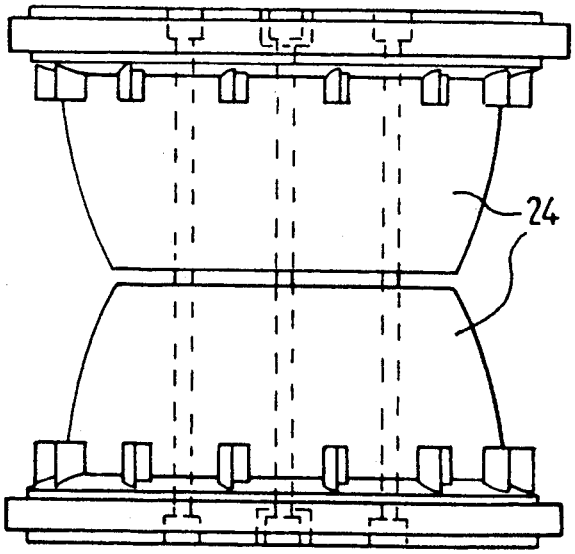
FIG. 17 represents two floats paired according to their small face.

The floats may, of course, be paired by means of their small base, as shown in FIG. 17.

With reference once more to FIGS. 1 to 4, the motorboat A is equipped in the forward section with two steering floats 24A, 24B paired as in FIG. 16. These floats are housed in the forward cavity defined by the fairing 20. They are mounted so as to swivel by means of ball bearings at the ends of the branches of a fork 60. The latter carries a pivot 62 which is supported by a cartridge-type bearing 64 with ball bearings and vertical stops, integrally fixed to the central module 12. The cartridge-type bearing may also be equipped with an elastic suspension so that the axles may absorb the variations in the level of water due to the waves.

Two drive floats 24C, 24D are housed under the rear fairing 22. In order to obtain optimum stability of the boat on the water and on land, these floats are mounted coaxially with their small faces turned towards each other and separated. The floats are mounted on two axles 64, 65 which swivel in bearings 68, 70 fixed to port and to starboard on the lateral walls of the rear module 14. These two axles also advantageously swivel in a differential 66. By virtue of this feature, when the boat is towed on the road it is possible to negotiate even very tight bends, the two rear floats rotating independently of each other and each at its own speed.

The boat is covered with a removable deck 71 comprising a pilot cabin 72 in which is fixed the steering bar 74, and a rest cabin 76 which are located essentially in the forward and central modules.

The bar may drive the assembly of the fork 60 and the forward floats at an angle of approximately 70° by means of conventional transmission means which are diagrammatically represented by a chain 78 which is wound around a pinion 80 carried by the pivot 62 of the fork.

The rear floats are driven by a motor 82 by means of a transmission similar to that of motor vehicles.

A slotted tube 84 intended to receive the lower end of a mast and which may be tightened around the latter by means of a gripping collar 86 projects on the roof of the rest cabin 76. The motor 82, two mooring points 88 and metal rings 90 are fixed on and project from the roof of the rear module.

The motor 82 may advantageously be fixed on the rear module 14 so as to be removed. To this end, the rear module is covered with an upper plate 85 welded or otherwise fixed to the edge of the lateral walls of the rear module. This plate has an opening 87 through which the shaft of the motor may pass in order to be mechanically connected to the differential 66. The base of the motor rests on the edge of said opening and is integral with the plate 85, for example by means of wing nuts 89 which have the advantage of permitting rapid assembly or dismantling of the motor.

Figure 5:
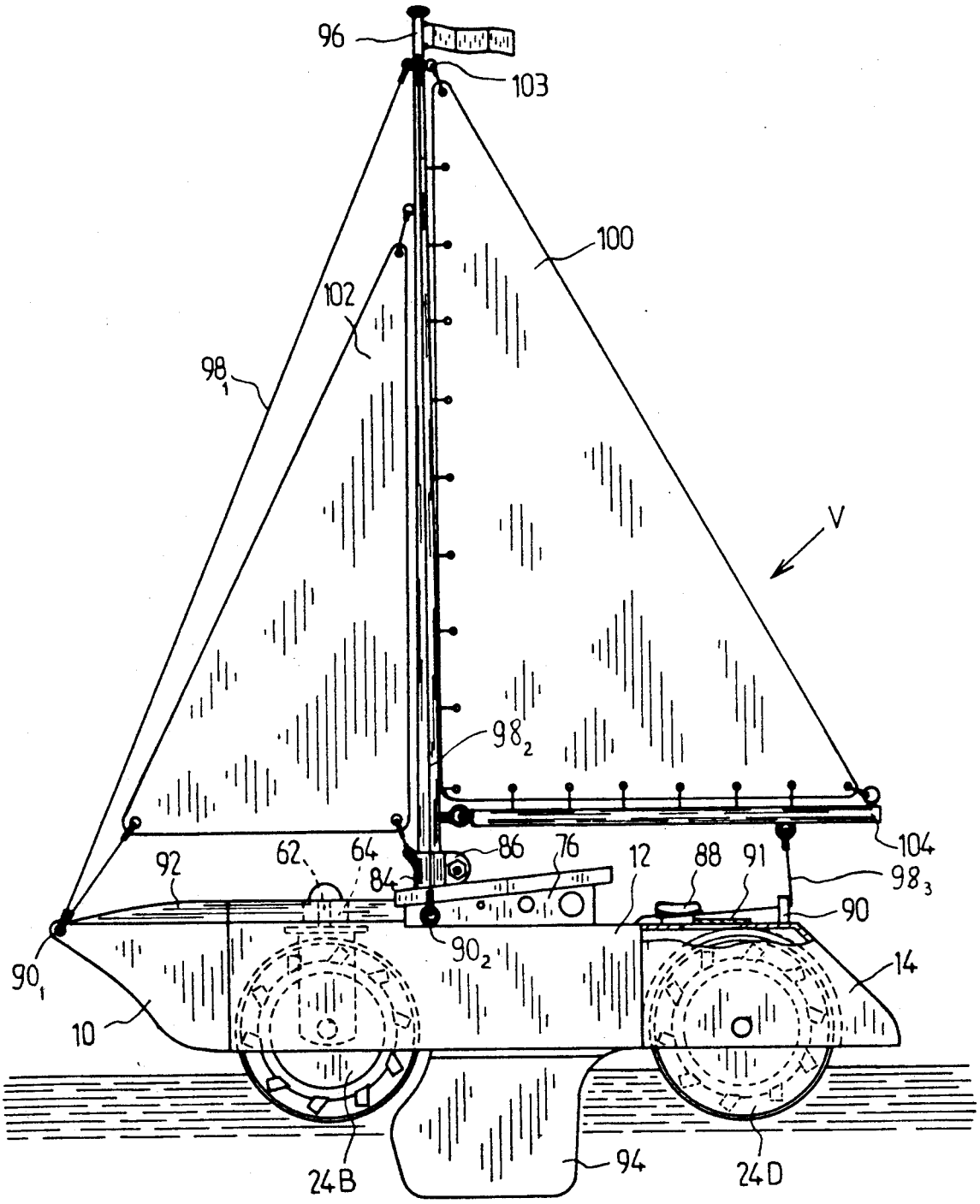
FIG. 5 is a view in elevation of a sailing boat obtained from the basic elements of FIG. 1.

As shown in FIG. 5, the boat may easily be converted into a sailing boat V. The latter still comprises the three basic modules which are assembled in the same manner. The only modifications consist in removing the pilot cabin and in replacing it with a forward deck 92, in fixing a drop-keel 94 under the central module, in additionally removing the motor and in blocking the opening 87 with a plate 91 to prevent water penetrating into the differential. Conventional fixing means are provided for this purpose in order to allow rapid assembly and dismantling of the keel. The end of a mast 96 which is held by means of the collar 86 and guys $98_1$ and $98_2$ fixed to guy rings $90_1$ and $90_2$ is inserted into the tube 84. The mast may also be inserted in a housing extending from the roof of the cabin to the bottom of the module 12 and be integrally held, in addition to the collar 86, by gripping means at the location of the bottom and a vertical wall mounted in the module 12 perpendicular to the mast. The mast may carry different types of sails, for example a large sail 100 and a jib 102. In a manner known per se, the vertical side of the large sail is attached to the mast by means of hooks 103 and its lower horizontal edge to a horizontal boom 104 articulated at the base of the mast. Cables $98_3$, passing through the rings 90 and which are wound around the mooring points 88 make it possible to maneuver the large sail and the other sails.

Figure 4:
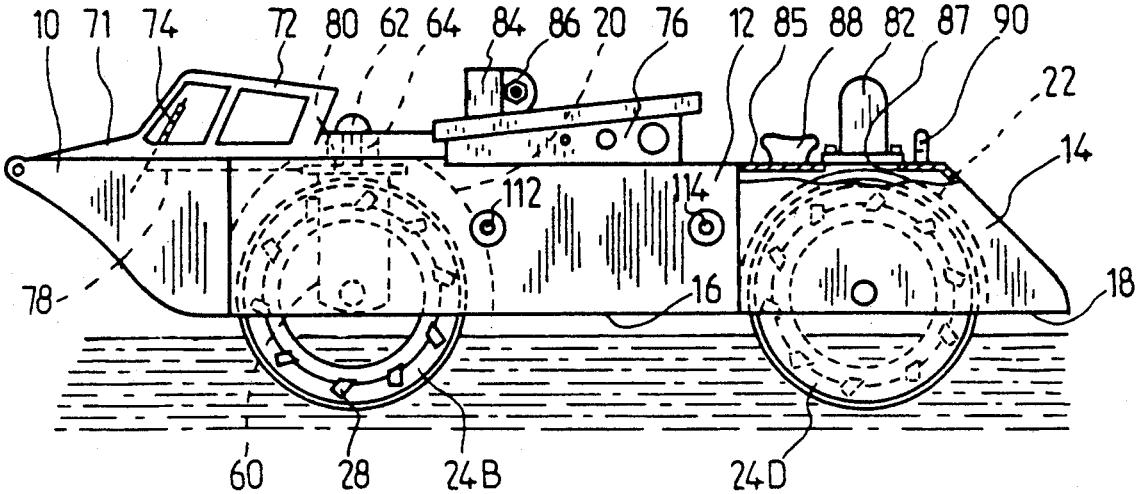
FIG. 4 is a view in elevation of the boat.
Figure 7:
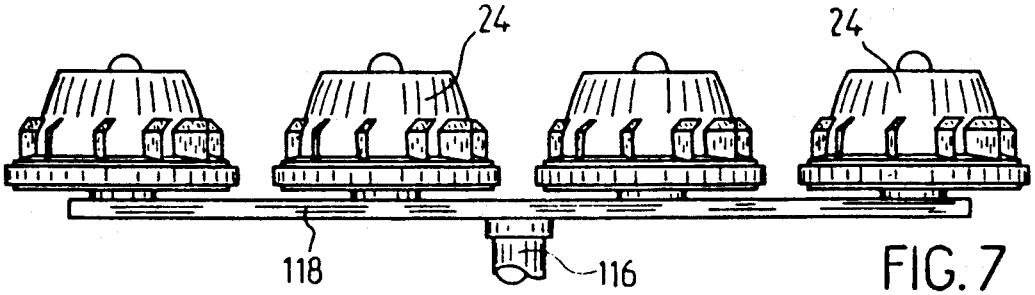
FIG. 7 shows a partial view of an axle of a trimaran equipped with four floats.
Figure 6B:
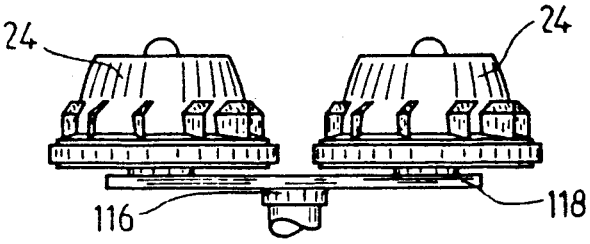
FIGS. 6*a* and 6*b* show a plan view of two versions of a trimaran both produced from basic elements, and comprising, respectively, a lateral float and two lateral floats.
Figure 6A:
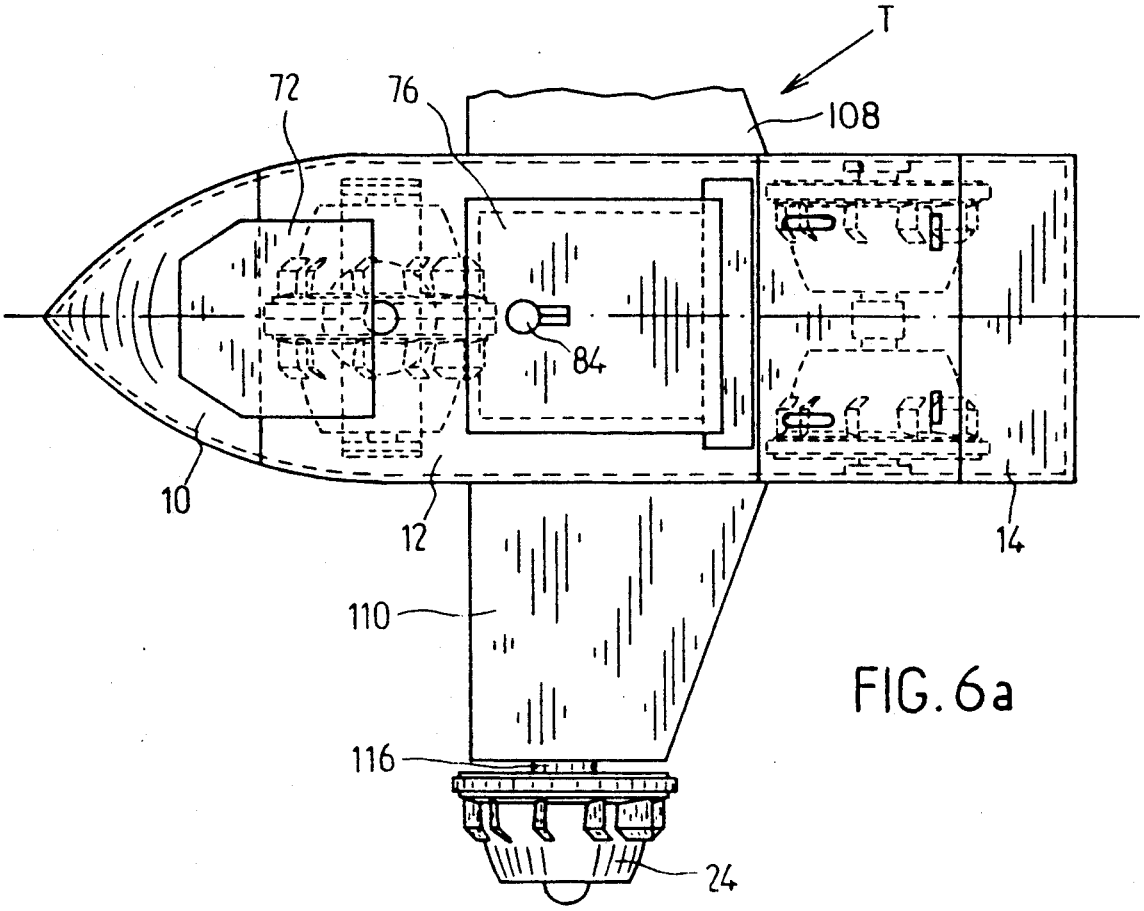

Using the boat of FIG. 1, it is also possible to produce the trimaran T of FIGS. 6*a* and 6*b*. This trimaran comprises a central body which is identical to that of the boat, that is to say formed from three modules equipped with rotating floats. Two lateral wings 108, 110 are fixed rigidly to the central module 12. Orifices 112, 114, to be seen in FIG. 4, are provided for this purpose. The wings are equipped at their free end with axles 116. In the version of FIG. 6*a*, a single float 24 is mounted so as to swivel on each axle whilst in the embodiments of FIGS. 6*b* and 7, the axles 116 carry crossmembers 118 along which two or more floats 24 in series are mounted so as to pivot. The crossmembers are advantageously articulated freely on the axles, enabling them to oscillate in a vertical plane. The floats may therefore remain constantly in contact with the surface of the water even when the latter is choppy.

The upper halves of the lateral floats may be protected by fairings. In order to drive the trimaran, use may be made of a motor or a mast and sails.

Figure 8:
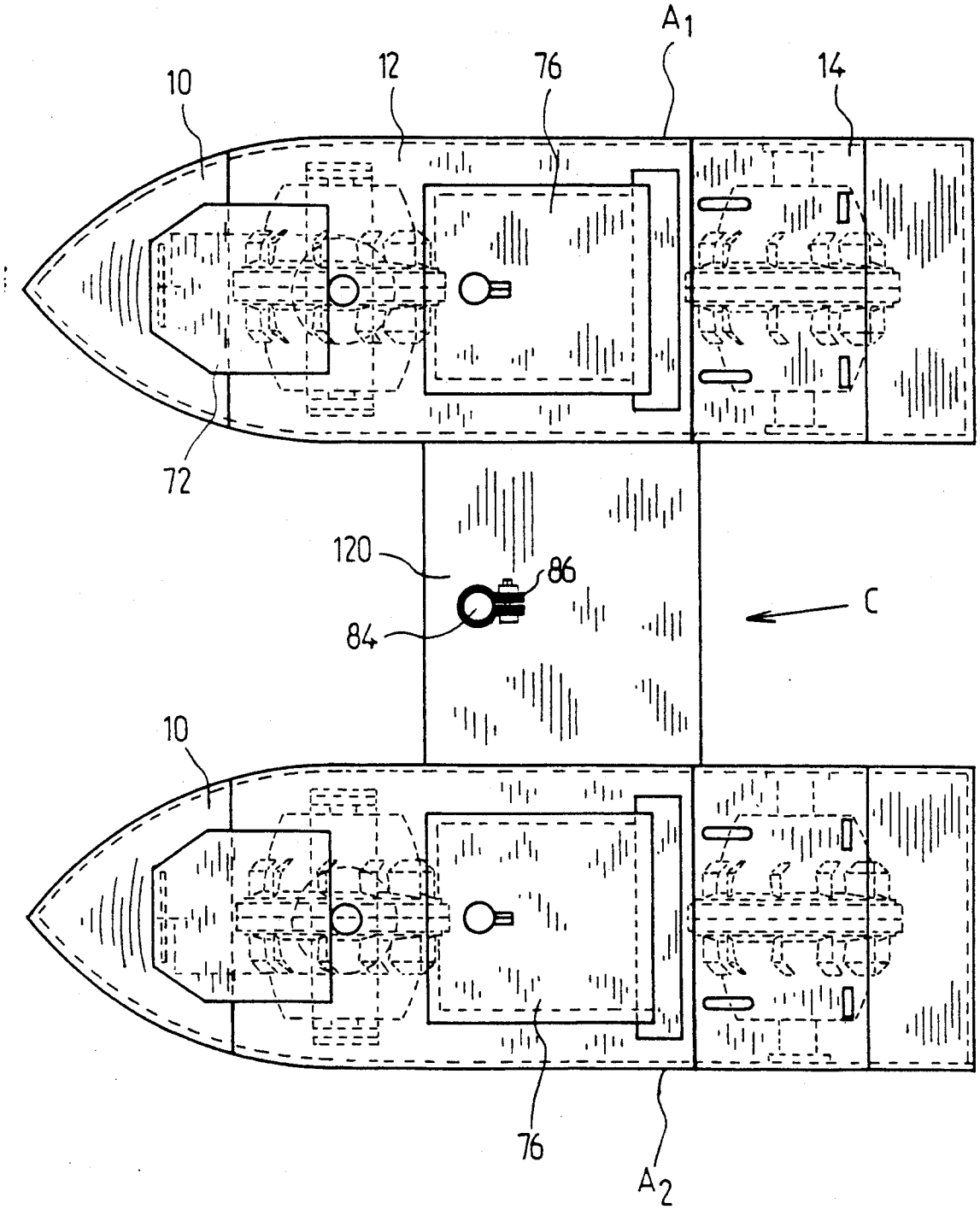
FIG. 8 represents a catamaran produced by means of two hulls according to FIG. 1.

FIG. 8 shows a catamaran C which is produced by means of two main bodies $A_1$ and $A_2$ which are identical to that of the motorboat of FIG. 1. These bodies are arranged in parallel and are rigidly connected together by means of a horizontal plate 120 which is fixed in the holes 112, 114 formed on the hulls (FIG. 4).

In the longitudinal axis of the plate and towards the front, a tube for supporting the mast 84 with its gripping collar 86 is embedded. Naturally, a bigger and longer mast and sails with a larger surface area will be chosen than for the sailing boat of FIG. 5. The user himself will choose the method of coupling the floats.

According to the load which it is desired to convey, it is possible, according to the invention, to use one or more intermediate modules which are inserted between the three main modules which have been described above. For example, the very long boat of FIG. 9 comprises a first intermediate module 122 which is inserted between the forward module in the shape of a stem 10 and the central module 12, and a second intermediate module 124 which is inserted between the central module and the rear module. These intermediate modules are equipped with rotating floats 24.

Figure 9:
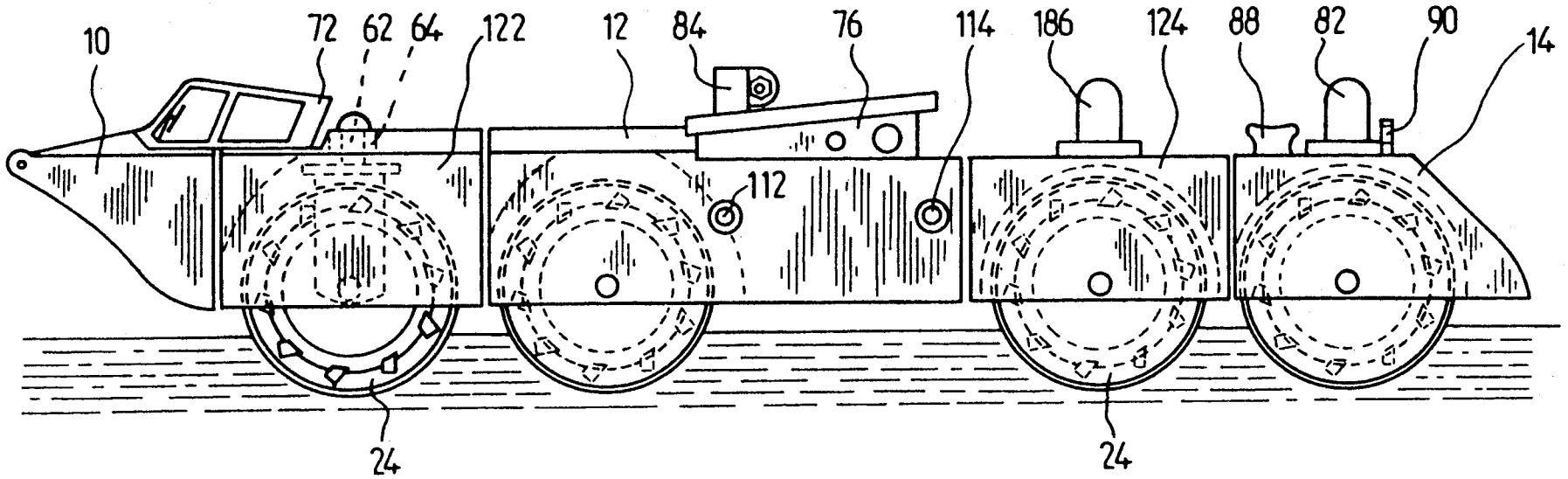
FIG. 9 is a view in elevation of a motorboat according to that of FIG. 1, but comprising in addition two intermediate modules.

In this way, it is possible to produce a large variety of vessels both as toys for children and small models for leisure, and full-size sporting vessels for use by adults. The power of the vessel may be increased by mounting a motor which drives the corresponding floats on all the intermediate modules or on some of them. In the case of FIG. 9, the second intermediate module 124 and the rear module are equipped with motors 186 and 82. The floats of the central module 12 are mounted so as to rotate freely and those of the first intermediate module 122 are used to steer the vehicle.

Figure 10:
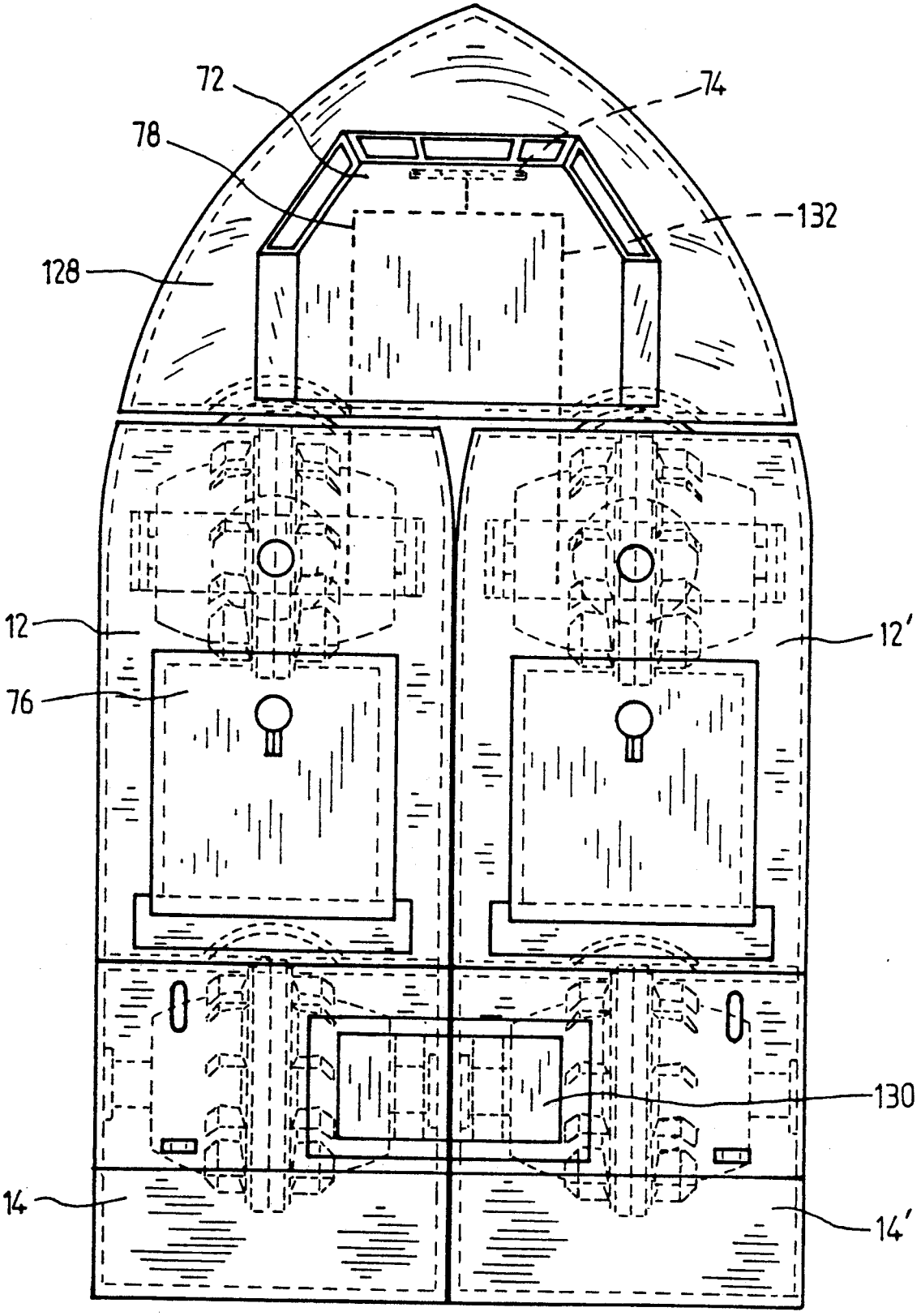
FIG. 10 represents a boat produced by means of two laterally coupled hulls.

FIG. 10 shows another method of coupling the modules in order to obtain new forms of vessels. In this case, use is made of two main bodies each formed from a central module 12, 12' and from a rear module 14, 14', arranged in a line. These two bodies are coupled by means of their lateral side and are made rigidly integral by means of conventional connecting means such that a vessel of a length double that of the boat of FIG. 1 is thereby obtained. The forward modules have been removed and replaced by a single module 128 whose hull is shaped in the form of a stem and which connects in a harmonious manner with the external lateral walls of the central modules 12, 12'. Naturally, it is possible to use one or more intermediate modules in each main body.

This vessel, designed for racing, has remarkable strength and stability. It may support a powerful motor 130 which drives the two pairs of paired rear floats by means of conventional transmission means. The two pairs of forward floats provide the steering of the vessel. They are controlled simultaneously by the bar 74 which is housed in a relatively spacious pilot cabin 72. The connection between the bar and the steering floats is provided by conventional transmission means 132.

Briefly, the invention makes it possible to produce, using a small number of basic elements and therefore with moderate expense, a large variety of navigation vessels. It is therefore possible to produce a vessel and which best suits the requirements, which increases the interest of users by giving them the impression of possessing several different vessels. The vessels according to the invention are able to navigate both on water or in muddy marshland and to run on land.

What is claimed is:

1. A navigation vessel comprising at least three main modules, including a forward module ending in a stem, a central module and a rear module, said central and rear modules each having a flat bottom and being rigidly assembled to each other by removable connection means; wherein the central module is in the form of a caisson with forward and rearward parallel lateral walls which are connected to a lateral wall of said forward module arranged parallel to said forward wall of said central module and a lateral wall of said rear module arranged parallel to said rearward wall of said central module in an uninterrupted fashion to form a regular hull from the stem to the stern, said lateral walls of the central module being connected together by means of spacers and each having orifices provided for attaching various accessories on the vessel; at least one of said modules being equipped with axles supporting rotating floats, said floats having a size sufficient to keep the hull entirely above the surface of the water, each float being provided with a plurality of rigid paddles spaced at a constant angle from one another, said panels having a concave shape in relation to the direction of rotation of said float, such that each paddle penetrates into the water substantially parallel to the surface of the water, and each paddle emerges therefrom slightly inclined to the surface of the water.

2. The navigation vessel as claimed in claim 1, said vessel further comprising at least one supplementary intermediate module which is inserted between the main modules.

3. The navigation vessel as claimed in claim 2, wherein the bottom of the central module has a semi cylindrical cavity protected by a fairing and in which at least one steering float oriented about a vertical axis is mounted, and wherein the bottom of the rear module and the intermediate modules also has a semi cylindrical cavity protected by a fairing and in which at least two driving floats fixed on an axle which rotates in bearings carried by the lateral walls of the modules are mounted.

4. The navigation vessel as claimed in claim 1, wherein the forward and central modules may be covered by a removable deck having a pilot cabin and a rest cabin.

5. The navigation vessel as claimed in claim 1, wherein the floats are constructed of a material having resistance to impacts and to corrosion, said floats having a hollow structure reinforced by internal partitions.

6. The navigation vessel as claimed in claim 1, wherein each float has a frustoconical shape including a large base and a small base, wherein said large base is equipped with a peripherial crown on which the paddles are fixed on an internal side ajacent to the frustoconical wall.

7. The navigation vessel as claimed in claim 6, wherein a steering assembly comprising two floats coupled together are provided on the central module and made integral by means of several bolts which pass axially through to provide for steering of the vessel.

8. The navigation vessel as claimed in claim 7, wherein the steering assembly of the two floats is mounted so as to rotate in bearings carried by the ends of the branches of a fork, said fork being provided with a vertical pivot which pivots in a bearing integral with the structure of the vessel, said assembly of the steering floats and of the fork being pivotally driven about the axis of the pivot by means of a steering wheel.

9. The navigation vessel as claimed in claim 7, wherein the crown of each float is provided with a rim for receiving a single tire having a triangular cross section between said two steering floats.

10. The navigation vessel as claimed in claim 6, wherein the rear module is equipped with at least two driving floats whose small bases are turned towards each other in a manner such that the peripheral crowns at said large bases are separated as much as possible from one another, said floats being mounted on distinct axles which rotates in ball bearings fixed on the lateral walls on the rear modules and in a differential.

11. The navigation vessel as claimed in claim 6 wherein the crown of each float is provided with a rim in which a solid or inflated tire may be inserted.

12. The navigation vessel as claimed in claim 1, wherein the paddles are in the form of bent blades comprising a first wall which is connected perpendicularly to the internal annular side of the float and which is inclined with respect to its associated radial plane, and a second wall bent at an obtuse angle with respect to the first wall.

13. The navigation device as claimed in claim 1, wherein the paddles of the floats are in the form of half cylinders with an axis parallel to the axis the float, the concave side of the paddles being oriented in a manner such that as each paddle penetrates into the water the concave side breaks the surface of the water and as each paddle emerges from the water its concave side also breaks the surface of the water.

14. The navigation vessel as claimed in claim 1, wherein the paddles are retractable to a position inside the float when the speed of the vessel exceeds a threshold.

15. The navigation vessel as claimed in claim 1, wherein the rear module is covered with an upper plate which has an opening the edge of which acts as a support for the base of a removable motor, said motor being integral with said edge by means of removable fixing elements, and wherein said motor transmits motion by means of said opening to a differential.

16. The navigation vessel as claimed in claim 1, in the form of a trimaran, comprising a hull formed from said three main modules comprising two lateral wings being fixed at one end on the lateral walls of the central module wherein at least one rotatable float is provided at a second end of each of said wings.

17. The navigation vessel as claimed in claim 16, wherein at said second end of each wing a cross member is provided which carries a plurality of floats mounted so as to rotate along the length of said member by means of a central axle integral with said wings.

18. The navigation vessel as claimed in claim 1, in the form of a catamaran, which comprises two identical assemblies of three main modules arranged in parallel at a distance from one another and connected together by means of a horizontal assembly plate, said plate having on its upper face means for fixing at least one mast for carrying sails.

19. The navigation vessel as claimed in claim 1, in the form of a barge, which comprises two identical assemblies each formed from a central module and a rear module, said assemblies being coupled along a lateral side and integral with each other in order to form said barge, and a forward module ending in a stem being fixed to the front of the two central modules and being connected in a continuous manner to said two assemblies, wherein said forward module is equipped with steering control means and with connection means connecting said control means to steering floats provided in said central modules of the two assemblies.

* * * * *